US006043794A

United States Patent [19]

Faulkner et al.

[11] Patent Number: 6,043,794

[45] Date of Patent: Mar. 28, 2000

[54] WHIP ANTENNA

[75] Inventors: Scott Anthony Faulkner, Harrisburg; Richard Nicholas Whyne, Mechanicsburg, both of Pa.

[73] Assignee: The Whitaker Corporation, Wilmington, Del.

[21] Appl. No.: 09/197,627

[22] Filed: Nov. 23, 1998

Related U.S. Application Data

[60] Provisional application No. 60/069,823, Dec. 16, 1997.

[51] Int. Cl.[7] ..... H01Q 1/42

[52] U.S. Cl. ..... 343/872; 343/702; 343/900; 343/906

[58] Field of Search ..... 343/700 MS, 702, 343/711, 713, 715, 795, 872, 900, 903, 906; 455/89, 90, 348; H01Q 1/24, 1/42

[56] References Cited

U.S. PATENT DOCUMENTS

| | | | |
|---|---|---|---|
| 4,513,338 | 4/1985 | Goodall et al. | 361/1 |
| 4,546,357 | 10/1985 | Laughon et al. | 343/702 |
| 4,644,366 | 2/1987 | Scholz | 343/895 |
| 4,800,392 | 1/1989 | Garay et al. | 343/700 MS |
| 4,987,424 | 1/1991 | Tamura et al. | 343/795 |
| 5,014,346 | 5/1991 | Phillips et al. | 45/89 |
| 5,363,114 | 11/1994 | Shoemaker | 343/828 |
| 5,412,392 | 5/1995 | Tsunekawa | 343/702 |
| 5,446,469 | 8/1995 | Makino | 343/702 |
| 5,644,320 | 7/1997 | Rossi | 343/702 |
| 5,709,832 | 1/1998 | Hayes et al. | 264/272.11 |
| 5,724,717 | 3/1998 | Gherardini et al. | 29/600 |
| 5,828,341 | 10/1998 | Delamater | 343/702 |

*Primary Examiner*—Don Wong
*Assistant Examiner*—Tho Phan

[57] ABSTRACT

An antenna (10) includes a first block-like portion (12) and a second mast portion (16) unitary with the first portion (12) at a first selected location. The first portion (12) has a selected area and shape to transceive a desired frequency band and includes a feed point (14) at a second selected location adapted to be electrically connected to a signal line (42) of an electrical article (52). The first portion (12) provides a wide frequency band and the second portion (16) provides flexibility for the antenna (10).

6 Claims, 3 Drawing Sheets

WHIP ANTENNA

This application claims benefit of Provisional Appl. 60/069,823 filed Dec. 16, 1997.

FIELD OF THE INVENTION

This invention is directed to an antenna and more particularly to a monopole whip antennae.

BACKGROUND OF THE INVENTION

The cellular communications industry including wireless palmtop organizers, cellular telephones and the like use a range of frequencies between 800 and 900 megahertz (MHz). These devices generally use a whip antenna that is tuned to provide optimum performance in the above frequency range.

It is well known in the art that the larger the surface area of the antennae the broader the band of frequencies the antenna can transceive within an acceptable performance level. As the surface area of the antenna increases, however, the flexibility of the antenna decreases. It is desirable that whip antennae be able to transceive as many frequencies as possible within the frequency band while remaining flexible.

SUMMARY OF THE INVENTION

The present invention is directed to an antenna including a first portion being block-like and having a selected area and shape to increase the width of a desired frequency band transceived by the antenna and a flexible second mast portion unitary with the first portion and extending outwardly therefrom at a first selected location. The second portion is thin and elongate and adapted to be contained in a whip. The first portion includes a feed point at a second selected location adapted to be electrically connected to a signal line of an electrical article. The first portion also has a reference potential, which in the embodiment shown, is ground. The first portion provides a wide frequency band for the antenna and the second portion increases the flexibility of the antenna and is used to tune the antenna. In the representative embodiment, the first portion, second portion and feed point are all disposed on a flexible film. The feed point also extends through a stiffening plate.

An embodiment of the invention will now be described by way of example with reference to the accompanying drawings.

DETAILED DESCRIPTION OF AN EMBODIMENT OF THE INVENTION

Figure 1:
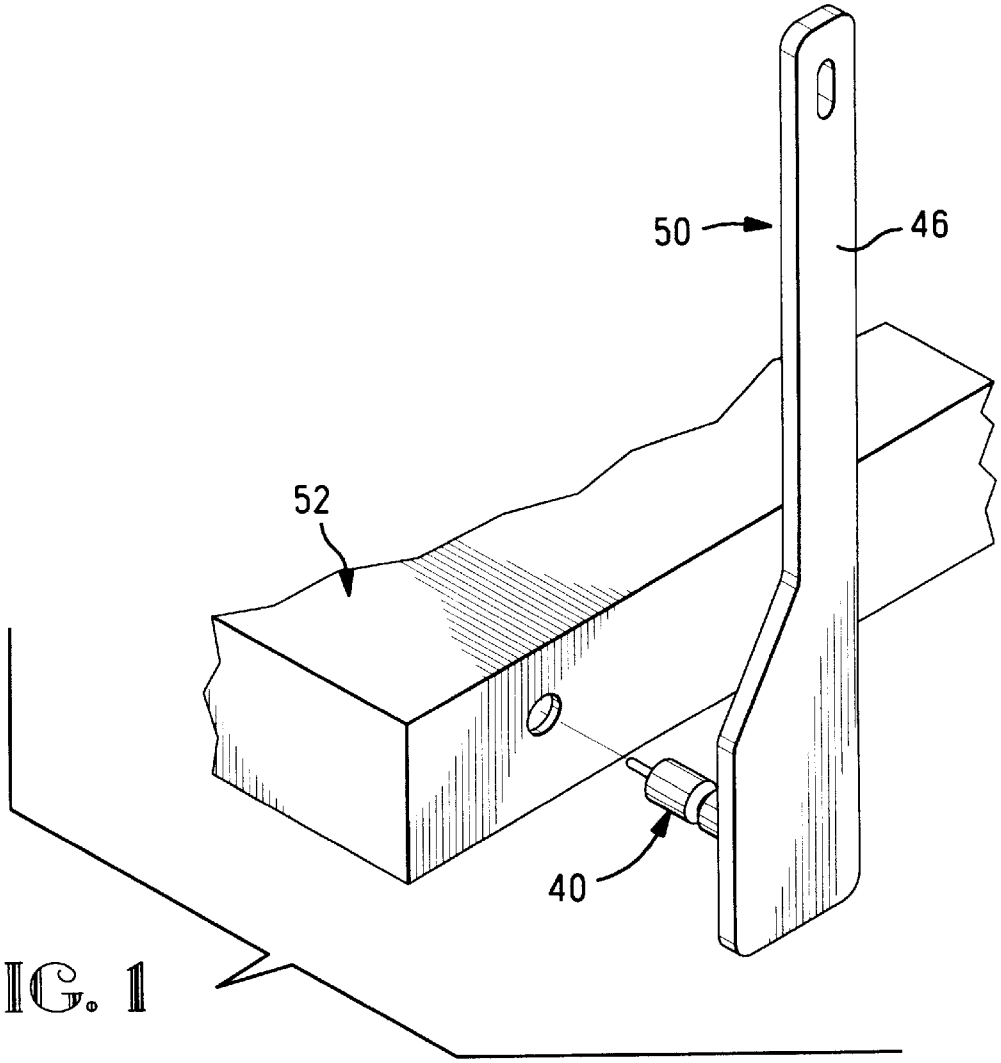
FIG. 1 is a pictorial view of an antenna assembly made in accordance with the invention with the assembly exploded from an electrical article.
Figure 2:
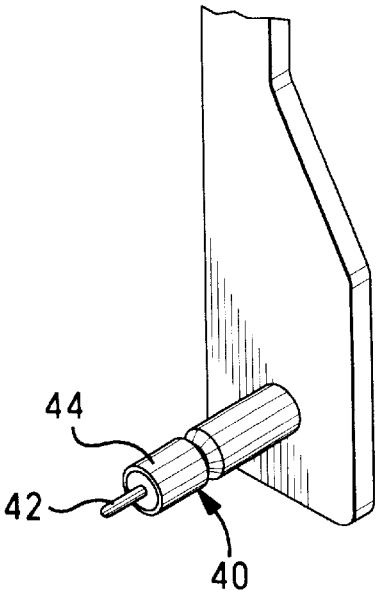
FIG. 2 is a pictorial view of a fragmentary portion of the opposite side of the antenna assembly 1.

Referring now to FIGS. 1 through 6, the antenna assembly 50 includes an antenna 10 disposed in an dielectric sleeve 46 that can be electrically connected and secured to an electrical article 52 via a coaxial contact 40, as best seen in FIGS. 1 and 2. It is to be understood that other ways, as known in the art, may also be used to mount the antenna to an electrical article and to provide electrical connection therebetween and to the reference potential.

Figure 3B:
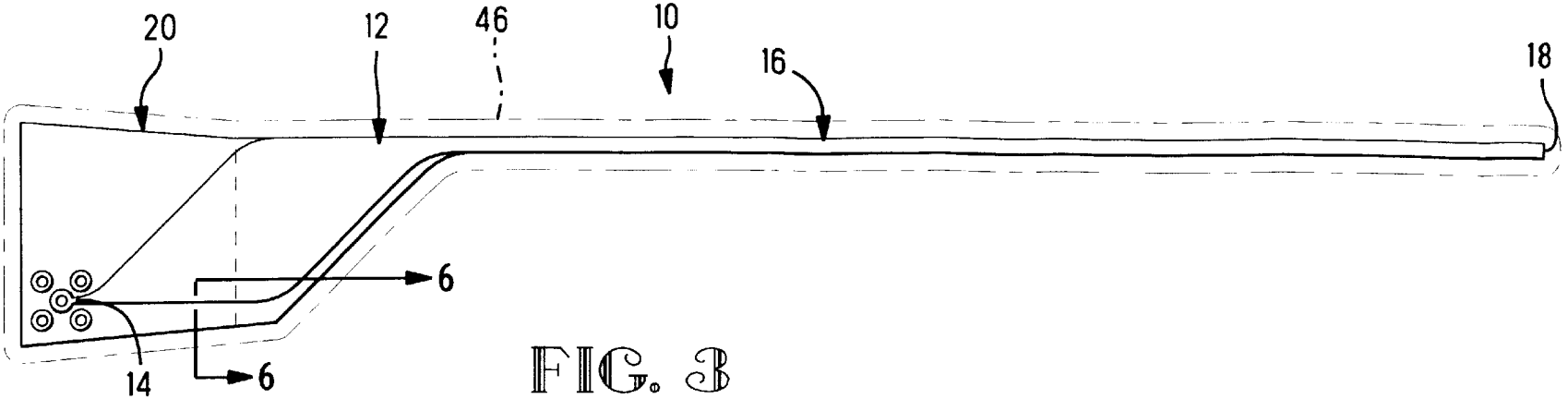
FIG. 3 is a plan view of the antenna made in accordance with the invention with the dielectric sleeve shown in phantom.
Figure 6:
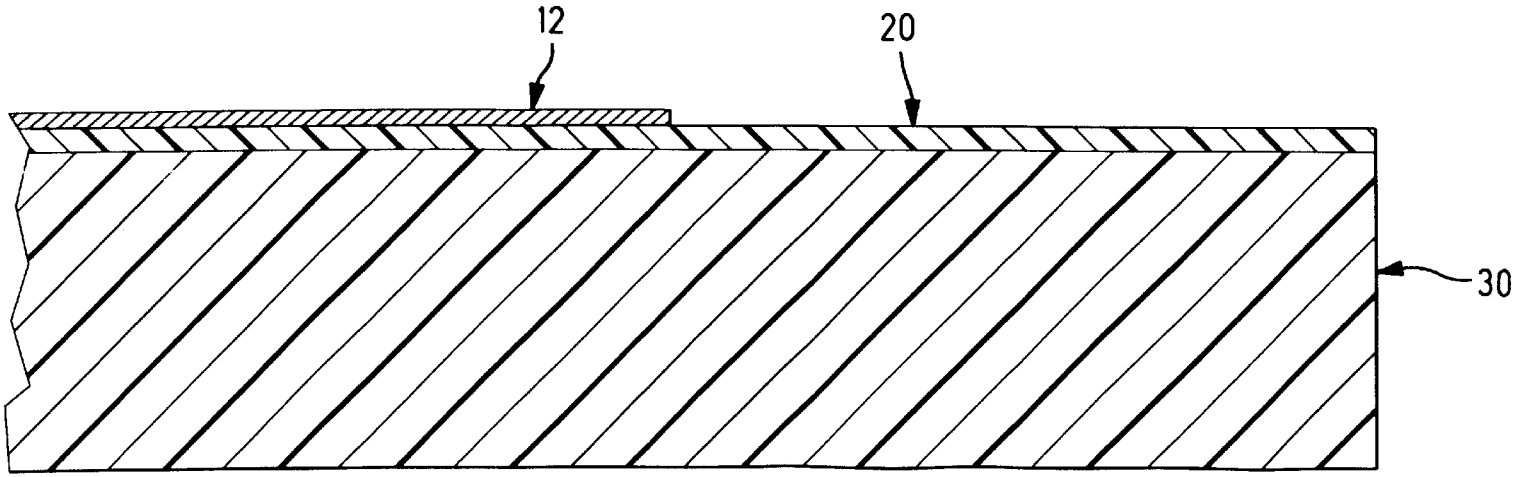
FIG. 6 is a sectional view taken view taken along line 6—6 of FIG. 3.
Figure 4:
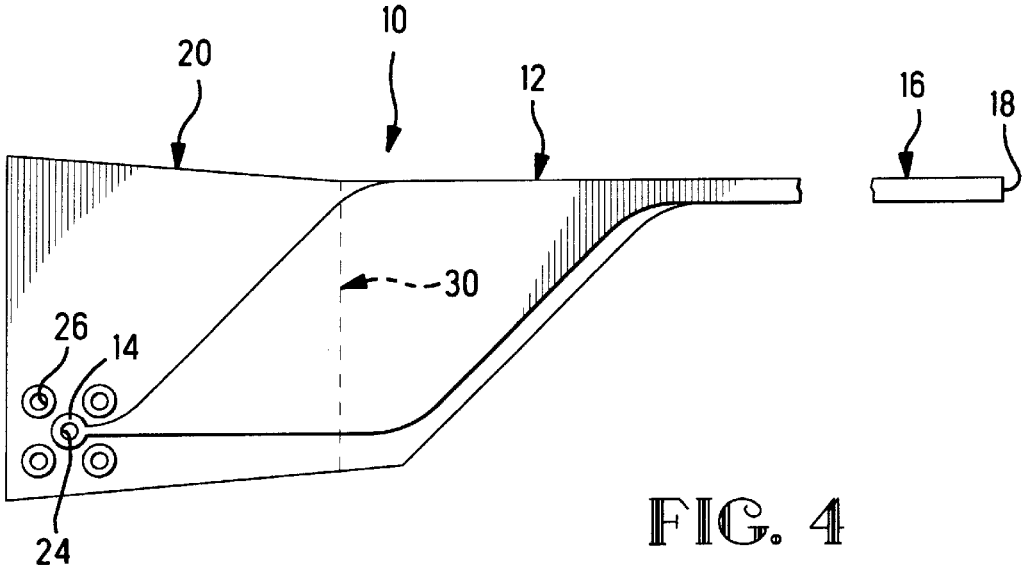
FIG. 4 is an enlarged fragmentary portion of the top side of the antenna of FIG. 3.
Figure 5:
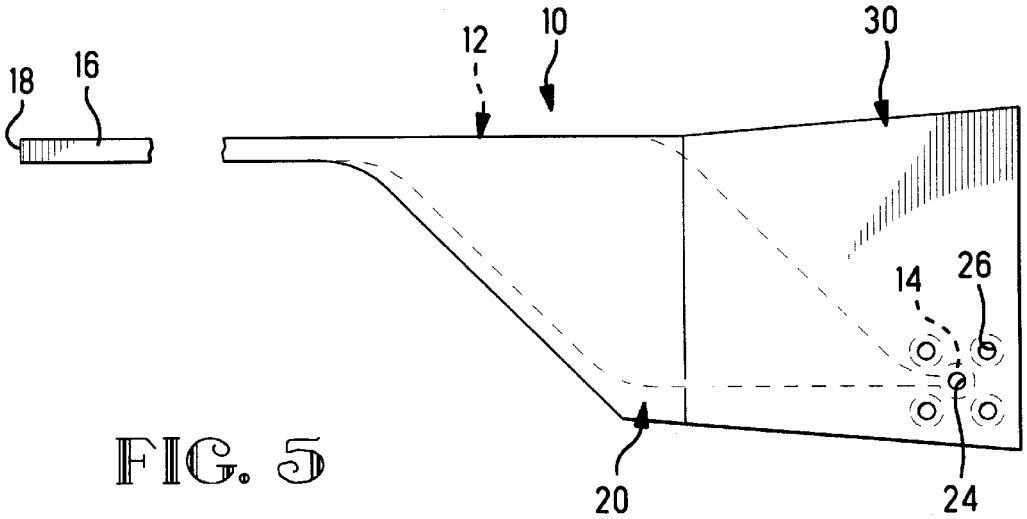
FIG. 5 is an enlarged fragmentary portion of the underside of the antenna of FIG. 3.

The antenna 10 includes a first block-like portion 12 having a selected area and shape to transceive a desired frequency band and a flexible mast-like second portion 16 unitary with the first portion 12 and extending therefrom at a selected location, as shown in FIG. 3. The details of the construction of the antenna 10 are best understood by referring to FIGS. 3 through 6. First portion 12 has a selected area and includes a feed point 14. In the embodiment shown, the feed point 14 is adapted to be electrically connected to a signal line of the electrical article 52 via a signal conductor 42 of coaxial contact 40, as shown in FIG. 2. Second portion 16 extends from first portion 12 at a selected location to a free end 18. Second portion 16 is thin and elongate. The antenna 10 is formed of copper or other suitable metal disposed on a layer of flexible film 20, such as Kapton, Mylar or the like. The flexible film 20 may be cut to the same shape as the antenna 10, or may extend beyond the edges of the antenna 10 to form a desired geometrical shape for the antenna assembly 50. In the embodiment shown, film 20 extends beyond first portion 12 at least a sufficient amount to provide support for an array of apertures 26 that are adapted to engage the ground conductor 44 of coaxial contact 40, shown in FIGS. 1 and 2. It is to be understood that other connectors or the like, as known in the art, may be used to attach the antenna assembly 50 to an electrical article. Other methods may also be used to provide a reference potential for the antenna. Apertures 26 surround the feed point 14 and its corresponding signal aperture 24. A piece of dielectric material 30 is disposed on the under side of the antenna 10 to provide a support layer for the antenna and for securing coaxial contact 40 thereto. FIG. 6 illustrates the structure of antenna 10 including the support layer 30, the film layer 20 and a part of first portion 12.

The area of first portion 12 is selected and shaped to increase the width of the frequency band. The antenna 10 can be tuned by adjusting the length of the second portion at the leading end 18 by trimming the conductive and dielectric layers until the desired tuning is achieved.

One way of making the antenna is to etch the desired antenna pattern from a layer of copper disposed on flexible film 20. It is to be understood that the metal layer may also be made from other conductive materials, such as conductive inks or the like that can be printed on the film and other metals that can be disposed on the film by etching or other techniques as known in the art.

After the antenna 10 has been cut in the desired shape from the dielectric material, the antenna 10 is tuned by trimming the leading end 18 of second portion 16. The support or stiffener layer 30, such as of dielectric material, is secured to the end of the antenna 10 and a dielectric sleeve 46 is then disposed over the antenna 10. The coaxial connector 40 is attached to the antenna assembly. Connector 40 may be soldered to the antenna or attached by a compliant terminal or other means as known in the art. The antenna assembly 50 is ready to be mounted to the electrical article 52. Typically this style of antenna can be mounted such that it can be rotated to lie along side the article or may be extended as shown representatively in FIG. 1.

The antenna assembly 50 of the present invention provides an antenna having the capability to transceive a broad frequency band and yet be flexible enough to be used for a cellular telephone or the like, while being robust. The antenna is cost effective to make, being of one piece of flexible circuitry with attendant advantages of precision and minimal assembly costs while permitting easy and accurate tuning. Additionally, use of flexible circuitry enables the inclusion of support circuitry, such as a matching network previously required in the electrical article (i.e., cellular phone), directly in the antenna while still maintaining a low cost.

It is thought that the antenna of the present invention and many of its attendant advantages will be understood from the foregoing description. It is apparent that various changes may be made in the form, construction, and arrangement of parts thereof without departing from the spirit or scope of the invention, or sacrificing all of its material advantages.

We claim:

1. An antenna comprising:

a first portion being block-like and having a selected area and shape to transceive a desired frequency band; and a flexible second portion unitary with said first portion at a first selected location, said second portion being thinner and longer than said first portion;

said first portion including a feed point at a second selected location adapted to be electrically connected to a signal line of an electrical article, said first portion being adapted to be referenced to ground;

whereby said first portion provides a wide frequency band for said antenna, and said second portion provides flexibility for said antenna.

2. The antenna as set forth in claim 1 wherein said feed point extends through a stiffening plate supporting said first portion.

3. The antenna as set forth in claim 1 wherein said ground reference is provided by a coaxial connector used to mount said antenna to an electrical device.

4. The antenna as set forth in claim 1 wherein said first portion, said second portion and said feed point are disposed on flexible film.

5. The antenna as set forth in claim 4 wherein said flexible film includes a plurality of apertures adjacent said feed point providing for mounting thereto of legs of a ground conductor of a coaxial connector electrically connected to said feed point.

6. The antenna as set forth in claim 5 wherein said antenna is encased in a dielectric sleeve to which is affixed said coaxial connector.

* * * * *